United States Patent [19]

Darlington

[11] 3,987,777

[45] Oct. 26, 1976

[54] FORCE MULTIPLYING TYPE ARCHERY BOW

[76] Inventor: Rex F. Darlington, 3540 Darton Road, Hale, Mich. 48739

[22] Filed: Feb. 10, 1975

[21] Appl. No.: 548,206

[52] U.S. Cl. ..... 124/23 R; 124/86

[51] Int. Cl.[2] ..... F41B 5/00

[58] Field of Search ..... 124/23 R, 24 R, 30 A, 124/30 R

[56] References Cited

UNITED STATES PATENTS

| | | | |
|---|---|---|---|
| 3,812,835 | 5/1974 | Smith | 124/24 R |
| 3,841,295 | 10/1974 | Hunter | 124/24 R |
| 3,851,638 | 12/1974 | Alexander | 124/30 R |
| 3,854,467 | 12/1974 | Hofmeister | 124/24 R |

*Primary Examiner*—Richard C. Pinkham
*Assistant Examiner*—William R. Browne
*Attorney, Agent, or Firm*—Barnes, Kisselle, Raisch & Choate

[57] ABSTRACT

An archery bow with an improved construction for reducing the holding force at the end of the draw, the bow having a non-flexing handle portion and flexing limbs extending therefrom with pulley means eccentrically mounted at each end of the handle portion with concentric pulleys at the ends of the flexing limbs and a bowstring passing over each said eccentric pulley and said concentric pulleys to assure equality of motion of said eccentric pulleys as the arrow is drawn to a release position.

4 Claims, 4 Drawing Figures

FORCE MULTIPLYING TYPE ARCHERY BOW

Figure 1:
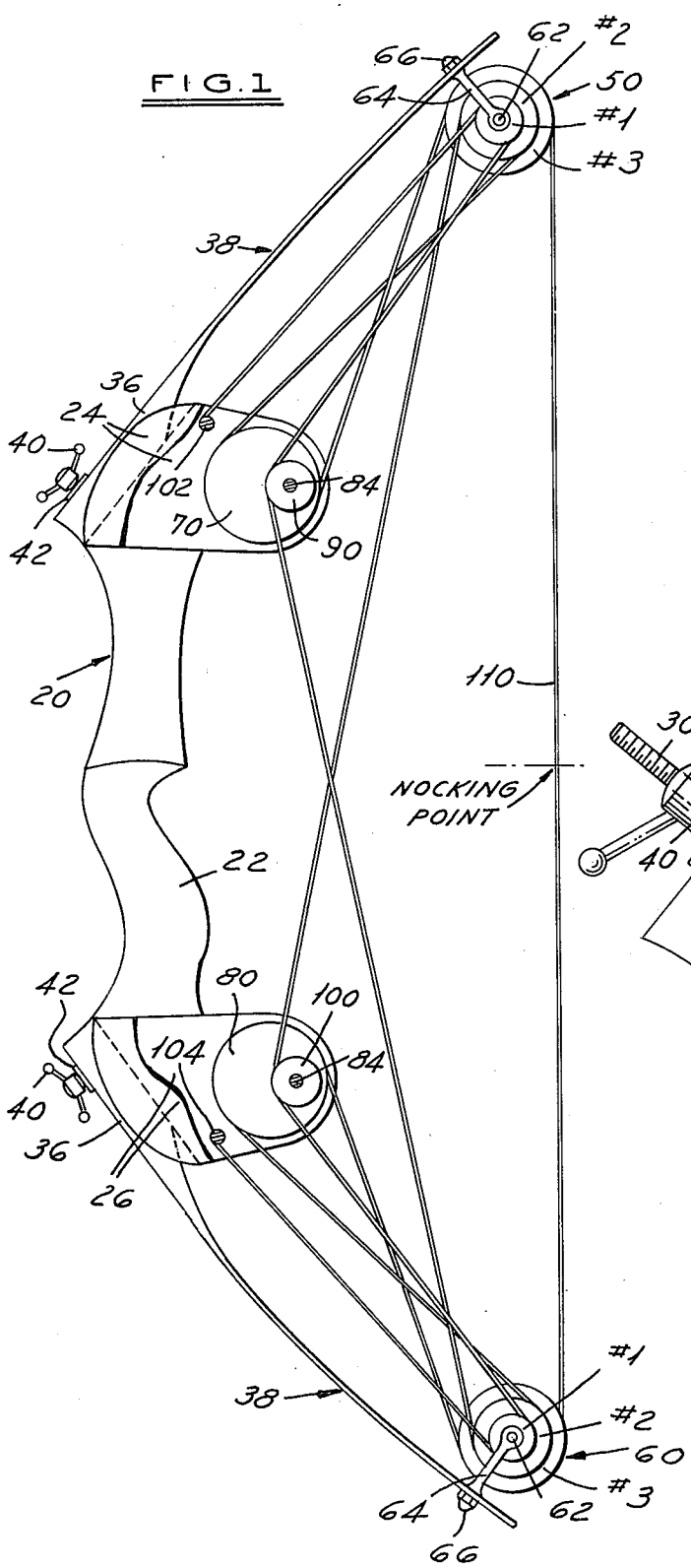

This invention relates to an Archery Bow and more particularly to that type of bow which provides a reduced holding force at the end of the draw.

An archery bow of the general type under consideration here is shown and described in a U.S. patent to H. W. Allen, No. 3,486,495, issued Dec. 30, 1969. In a standard bow, the force with which the arrow is dispatched is dependent on the resilience of the limbs of the bow. An archer's bow will have a pound rating varying all the way from 15 to 100 pounds. When the rating gets above 35 pounds, it requires a rather strong person to pull the bow back to the release position and to hold the position while the arrow is aimed prior to release.

With the improved bow construction, the pull on the bowstring is high at the beginning of the draw but the arm at this point is able to exert a maximum force. As the draw progresses a little beyond mid-point, there is an overcenter action on eccentric pulleys which decreases the draw force needed to maintain the bowstring in drawn position without decreasing the energy stored in the limbs of the bow. Thus, at full draw, it is relatively easy to hold the arrow and bowstring and much easier to perfect the aiming technique and the proper finger release.

The present invention is directed to an improvement in the Allen bow construction wherein a pulley system provides a mechanical advantage which makes it possible to limit the travel of the bow limbs to a minimum and still achieve the desired draw distance. The amount of cable that is gained in travel as the bow is drawn allows a smooth change in leverage over a much greater range, allowing a greater reduction in holding force and also makes possible a simple attachment of a positive timing device to the eccentric cams.

Another feature of the invention lies in the location of the cam or overcenter devices at the bow handle where sturdier mounts can be provided and the weight of the devices is closer to the center of gravity of the bow and will not effect the limb mass.

A further object is the use of strictly circular pulleys at the distal ends of the bow limbs, thus reducing the inertia of the ends of the limbs and reducing the tendency to rebound.

A further feature of the invention lies in the fact that the location of the anchor points of the bowstring can be retained at the bow handle to provide a more solid base for the anchor and avoid addition of weight at the end of the bow limbs.

Another advantage of the construction lies in the smooth transition of force as the released string moves in its driving stroke. Ordinarily, a heavier bow requires a stiffer arrow since the initial shock of release is apt to bend the arrow and cause it to depart from course. With the present invention, the combination of the mechanical advantage and overcenter action results in gradual and smooth initial application of force of the arrow which peaks only after the arrow has started its travel. This permits much lighter weight and stiffness in arrows than was possible with previous conventional or variable force bows. For example, an arrow designed for a 25 pound bow can be used in a 50 pound bow. This reduction in arrow size for a larger bow results in a large gain in arrow speed.

Other objects and features of the invention relating to details of construction and operation will be apparent in the following description and claims in which the principles of operation, together with the best mode presently contemplated for the practice of the invention, are set forth.

DRAWINGS accompany the disclosure and the various views thereof may be briefly described as:

FIG. 1, a side view of a bow constructed according to the present invention.

Figure 2:
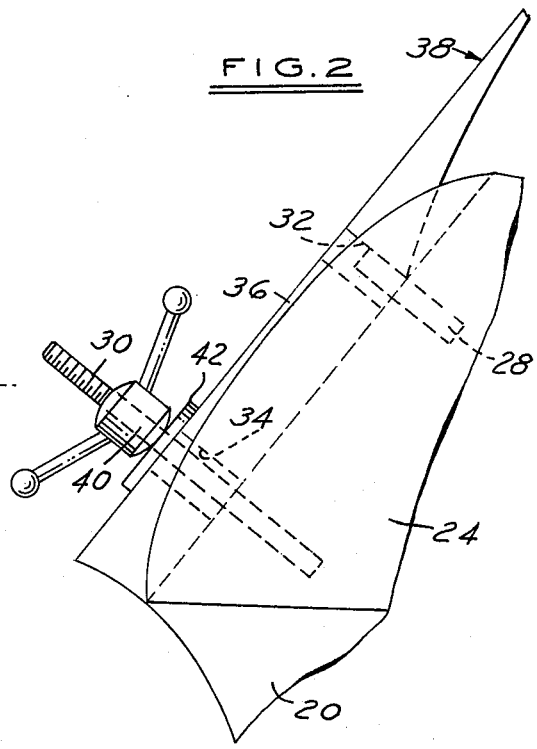

FIG. 2, a view of a construction which permits adjustment of draw weight of the bow.

Figure 3:
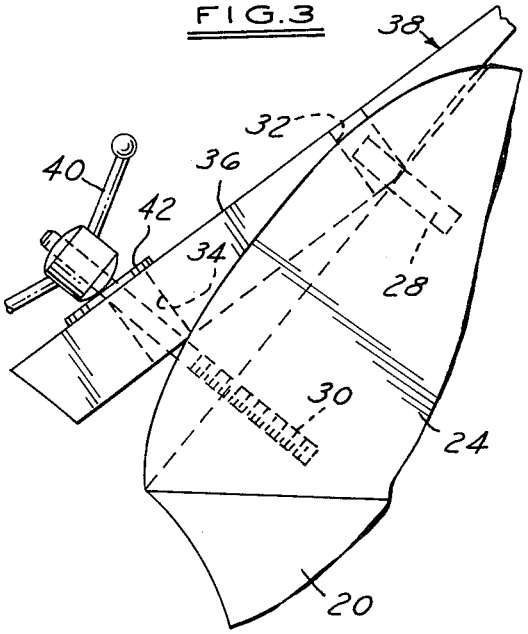

FIG. 3, a view showing an adjustment position.

Figure 4:
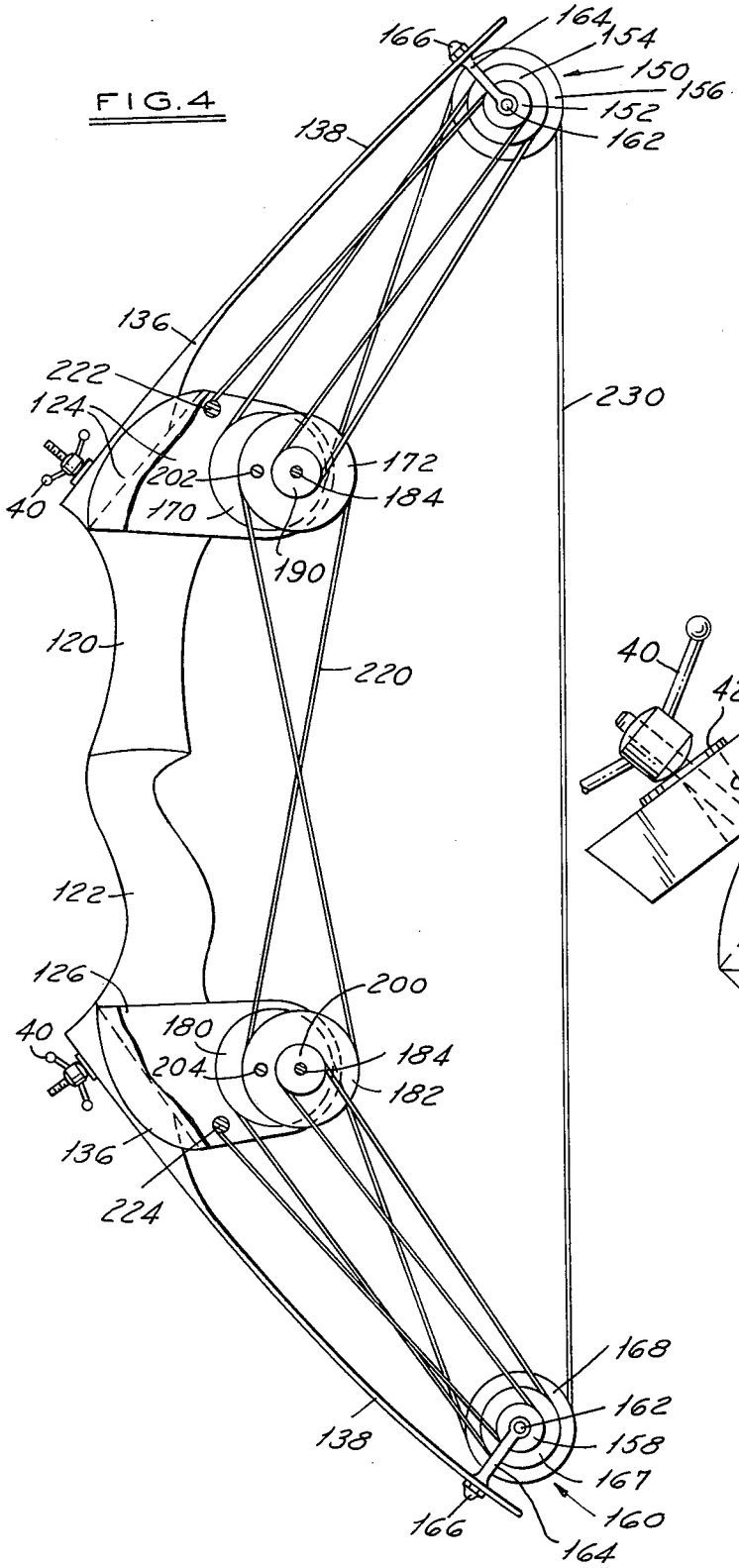

FIG. 4, a side view of a modified bow construction.

With referencee to FIG. 1, a bow handle 20 is shown having a grip section 22 and limb mounting sections 24 and 26. The limb mounting sections have an angled fore-surface diverging away from the front of the bow. As shown in FIGS. 2 and 3, these latter sections have a locating pin 28 projecting perpendicularly to the angled fore-surfaces and a longer threaded pin 30 spaced therefrom. These pins are received in holes 32 and 34, respectively, in the proximal mounting and 36 of a bow limb 38. A thumb screw-nut 40 acting on a washer 42 serves to control the angular adjustment of each limb. In FIG. 3, a bow limb is shown in acock position with the nut 40 backed off considerably on the pin 30. It will be noted that the bottom of the screw-nut is spherically contoured to accept the varying angles. Also, the curve of the bow limb, as it thins down, permits the adjustment without interference as shown in FIG. 3.

At the digital end of each bow limb 38 is a pulley set designated, respectively, as 50 and 60. There are three pulleys in each of these sets mounted to rotate independently on a pivot axle or shaft 62 which is carried transversely of a single or bifurcate bracket 64 held on by a covered nut 66. These three pulleys in each set 50 and 60 are shown in different diameters to clarify the present disclosure although they might be the same diameter and are preferably so to simplify the construction.

The mounting sections 24 and 26 of the bow handle each carry a base pulley 70 and 80, respectively, eccentrically mounted on a pivot or shaft 84. Adjacent each pulley 70 and 80, mounted for rotation on the axis 84, are small rider pulleys 90 and 100, respectively. Pulleys 70 and 80 rotate in the opposite directions to pulleys 90 and 100. For convenience, shaft 84 is used to mount these pulleys 70 and 90 at one end and 80 and 100 at the other end. Since they rotate independently and in opposite directions, they could be mounted on independent axes.

On the mounting section 24 and 26 adjacent the base pulleys 70 and 80 are bowstring anchor posts 102 and 104. These anchor posts provide adjustment either by wrapping the bowstring around the anchor post or by a conventional turning post which can be locked in position.

The course of the bowstring 110 is shown in FIG. 1 of the drawing and follows the same pattern at each end. From anchor post 102 to pulley No. 1 of set 50, to eccentric rider pulley 90, to pulley No. 2 of set 60, to base pulley 80, to pulley No. 3 of 60 to the nocking area of the bowstring. At the other end, from anchor post 104 to pulley No. 1 of set 60, to eccentric rider pulley 100 to pulley No. 2 of set 50, to base pulley 70, to pulley No. 3 of set 50 and to the nocking area of the bowstring.

Thus, in the operation of the bow, a pulling back of the bowstring 110 at the nocking point will cause rotation of pulleys 70–90 and 80–100 about the axis 84, and at a certain point in the draw, about two-thirds of the distance, the eccentrically mounted pulleys 70 and 80 will go over center and releive the draw pressure while retaining the loading on the bow limbs. This results from a change in the mechanical advantage as the effective diameter of the eccentric pulleys decreases on the load side while increasing on the force side.

In FIG. 4, a modified structure is shown with a bow handle portion 120 with grip portion 122 and limb mounting sections 124 and 126. The limb mount is the same as illustrated in FIG. 2 in connection with the embodiment of FIG. 1. Thus, the proximal or root of the limb sections are shown at 136 and the thinner limb portions at 138.

Again at the digital ends, respectively, of the bow limbs 138 are pulley sets 150 and 160 each having three pulleys mounted to rotate independently on a pivot axle or shaft 162 in a bracket post 164 held on by a nut 166. Here again, the three pulleys can be the same size and are shown in different diameters to facilitate the understanding of the disclosure. On each mount section 124 and 126 are respective tripple pulley sets mounted on a pivot axis 184. As viewed in FIG. 4, these pulley sets comprise, respectively, a base (primary) pulley 170, a timing (tertiary) pulley 172, and a small top (secondary) pulley 190, in the top set, and a base (primary) pulley 180, a timing (tertiary) pulley 182, and a small top (secondary) pulley 200 in the bottom set. A screw 202 and a screw 204 hold pulleys 170 and 172 and 180 and 182 from rotating relative to each other.

In the stringing of the bow, first of all, a belt cable designated as a timing cable 220 is run on to the two timing pulleys 172 and 182 with a cross-over in the center so these pulleys rotate in opposite directions. The main bow string 230 has an anchor point 222 at the top mount 124 and an anchor point 224 at the bottom mount 126. Starting at anchor point 222 the bowstring 230 runs around the small pulley 152 in set 150 to the small pulley 190 and around back to intermediate pulley 154, back to pulley 170 and thence to pulley 156 in set 150 and down through the nock point area to the bottom set 160.

From anchor point 224 the bowstring 230 runs to small pulley 158 in set 160, back to pulley 200 and around back to intermediate pulley 167, back to center pulley 180 and then around large pulley 168 to the nocking area of the bowstring.

Thus, drawing force on the bowstring acts through the pulleys to rotate the eccentric pulley assemblies around pivot points 184. The pulley assembly based on pulley 180 will rotate in a clockwise direction around pivot 184. The pulley assembly based on pulley 170 will rotate in a counterclockwise direction. Since the timing cable 220 passes around pulleys 172 and 182 mounted concentrically on pivots 184, the operating distance between these pulleys will always be the same. The timing cable insures the same degree of motion at each end of the bowstring.

In this embodiment, as in the previous one, the eccentric motion of pulleys 170 and 180 around pivot 184 will ultimately relieve the pressure needed to maintain the bowstring in drawn position as the pulleys move to an overcenter or cocked position.

In the claims, the proximal pulley sets at 70 and 80 of FIG. 1 and 170 and 180 of FIG. 4 are referred to as first pulley means. The outlying or remote pulley sets 50 and 60 of FIG. 1 and 150, 160 of FIG. 4 are referred to as second pulley means. In addition, the first pulley means is defined as having an eccentric primary pulley and a concentric secondary pulley. The timing pulleys 172 and 182 of FIG. 4 are referred to as tertiary pulleys.

The embodiment illustrated in FIG. 1 may be strung somewhat differently to obtain the same result. It is essential in each case that the pulleys be disposed such that strands crossing the center portion of the bow be offset from the arrow position to provide arrow clearance. In addition, the bowstring itself may be of standard material and the lines connecting the various pulleys may be a flexible cable of high tensile strength conected at each end of the bowstring.

An alternative stringing in FIG. 1 can originate at anchor point 102 and pass around a pulley No. 1 in the second pulley means 50 at the same end and thence directly down to pulley 100. From pulley 100 the strand or cable passes to pulley No. 3 of set 60 and then up to the eccentric pulley 80, back to pulley No. 2 of set 60 and then to the bowstring. The opposite end would be the same from anchor point 104 to pulley No. 1 (60), pulley 90, pulley No. 3 (50), eccentric pulley 70 and over pulley No. 2 (50) to the bowstring.

The operation of this alternative stringing is the same as described in connection with FIG. 1.

While the showing in the drawing is partially diagrammatic to facilitate the explanation, it will be appreciated that the plates 24 and 26 are double and in spaced relation, one on each side of the handle portion, to mount the pulleys on axle shafts extending between the double plates. The forward edges of the plates serve as guides and stabilizers for the proximal ends 36 of the bow limbs 38 in any adjusted position.

1. In a shooting bow having a handle portion and flexing limbs extending outwardly from the handle portion, that improvement which comprises:

a. a bowstring anchor point adjacent each end of the handle portion, b. a first pulley means mounted to rotate eccentrically on a first axis on each end of said handle portion adjacent the proximal ends of said flexing limbs to support a portion of a bowstring.

c. a second pulley means mounted substantially at the free end of each limb of the bow to support another portion of a bowstring, d. a bowstring having each end anchored at said respective anchor points and having a midsection nock stretch extending uninterruptingly between said second pulley means at said free ends of said limb portions, and spanning uninterruptingly between said anchor point and said second pulley means, the portions of said bowstring between said midsection and said ends being threaded over said first and second pulley means to cause said first eccentrically mounted pulley means to rotate and to revolve around said first axis to a point in the drawing of said bowstring wherein the mechanical advantage increases to assist in the retention of the string in the draw position, e. a secondary pulley concentrically mounted on an axis common to that of first pulley means, f. said second pulley means comprises a plurality of pulleys all mounted on a common axis, g. said first pulley being belted by a run of said bowstring to a pulley in said second pulley means at the same end of the bow by a portion of said bowstring, and h. said secondary pulley being belted by a run of which extend from a pulley in the second pulley means to the secondary pulley and then to another pulley in the same second pulley means at the same end of the bow.

2. In a shooting bow having a handle portion and flexing limbs extending outwardly from the handle portion, that improvement which comprises:

a. a bowstring anchor point adjacent each end of the handle portion, b. a first pulley means mounted to rotate eccentrically on a first axis on each end of said handle portion adjacent the proximal ends of said flexing limbs to support a portion of a bowstring, c. a second pulley means mounted substantially at the free end of each limb of the bow to support another portion of a bowstring, d. a bowstring having each end anchored at said respective anchor points and having a midsection nock stretch extending uninterruptingly between said second pulley means at said free ends of said limb portions, and spanning uninterruptingly between said anchor point and said second pulley means, the portions of said bowstring between said midsection and said ends being threaded over said first and second pulley means to cause said first eccentrically mounted pulley means to rotate and to revolve around said first axis to a point in the drawing of said bowstring wherein the mechanical advantage increases to assist in the retention of the string in the draw position, e. a secondary pulley is concentrically mounted on an axis adjacent to that of each said first pulley means, f. said second pulley means at each end comprises a plurality of concentrically mounted pulleys, and g. said bowstring, between each anchor point and the nocking area, extending from an anchor point at one end of the bow to a pulley in the second pulley means at the same end of the bow, thence to a secondary pulley, thence to a pulley in the second pulley means at an opposite end, thence to the first pulley means at said opposite end, thence to a pulley of said second pulley means at said opposite end, and thence to the nocking area.

3. In a shooting bow having a handle portion and flexing limbs extending outwardly from the handle portion, that improvement which comprises:

a. a bowstring anchor point adjacent each end of the handle portion, b. a first pulley means mounted to rotate eccentrically on a first axis on each end of said handle portion adjacent the proximal ends of said flexing limbs to support a portion of a bowstring, c. a second pulley means mounted adjacent the substantially at the free end of each limb of the bow to support another portion of a bowstring, d. a bowstring having each end anchored at said respective anchor points and having a midsection nock stretch extending uninterruptingly between said second pulley means at said ends of said limb portions, and spanning uninterruptingly between said anchor point and said second pulley means, the portions of said bowstring between said midsection and said ends being threaded over said first and second pulley means to cause said first eccentrically mounted pulley means to rotate and to revolve around said first axis to a point in the drawing of said bowstring wherein the mechanical advantage increases to assist in the retention of the string in the draw position, e. a secondary pulley is concentrically mounted on a second axis adjacent to said first pulley means, and a tertiary pulley is affixed to said first pulley means and concentric with said first axis, said second pulley means comprises a plurality of concentrically mounted pulleys, a timing cord belting said tertiary pulleys to each other disposed wherein said tertiary pulleys will rotate in opposite directions at the same speed, and h. said bowstring, between each anchor point and nocking area, extending from an anchor point on one end of the handle portion at one end of the bow to a pulley of said second pulley means at the same end of the bow, thence to said secondary pulley, thence to a pulley of said second pulley means, thence to said first pulley means, thence to a pulley of said second pulley means, all at the same end of the bow, and thence to the nocking area.

4. In a shooting bow having a relatively rigid handle portion and flexing limbs extending outwardly from the handle portion, that improvement which comprises:

a. spaced anchor points on the handle portion of said bow for a bowstring, b. a first pulley at each end of said handle portion pivotally mounted to revolve around a first axis eccentric to the periphery of the pulley, c. a second pulley concentrically mounted on each said first pivot axis, d. a series of third, fourth, and fifth pulleys mounted to rotate independently of each other on a second pivot axis at the end of each said flexing limbs, and e. means to drive said first eccentrically mounted pulleys rotatably around said first pivot axis comprising a bowstring anchored at each end to respective anchor points, having a midsection containing a nock stretch extending uninterruptingly between each said series of third, fourth, and fifth pulleys, that portion of the bowstring at each end between said anchor points and said midsection passing from said midsection to said fifth pulley at one end of one limb of the bow, thence to said first pulley at the end of the bow handle which mounts said one limb, thence to the fourth pulley at said one limb, thence to the second pulley and the third pulley at the end of the other limb of the bow and to an anchor point on the handle which mounts said other limb.

* * * * *

UNITED STATES PATENT OFFICE

CERTIFICATE OF CORRECTION

PATENT NO. : 3,987,777

DATED : October 26, 1976

INVENTOR(S) : Rex F. Darlington

It is certified that error appears in the above-identified patent and that said Letters Patent are hereby corrected as shown below:

Col. 4, line 66, before "first" insert "said".

Col. 5, line 1, after "pulley" insert "means".

Col. 5, line 6, before "which" insert "said bowstring"; change "extend" to "extends".

Col. 5, line 58, cancel "adjacent the".

Col. 6, line 2, before "ends" insert "free".

Col. 6, line 17, before "said" insert "f.".

Col. 6, line 19, before "a" insert "g.".

Signed and Sealed this

Fourth Day of January 1977

[SEAL]

*Attest:*

RUTH C. MASON
*Attesting Officer*

C. MARSHALL DANN
*Commissioner of Patents and Trademarks*